United States Patent [19]

Glasgow

[11] 4,249,637

[45] Feb. 10, 1981

[54] TRIPOD STEPLADDER

[76] Inventor: David A. Glasgow, 14723 Easter Ave., Apple Valley, Minn. 55124

[21] Appl. No.: 80,073

[22] Filed: Sep. 28, 1979

[51] Int. Cl.[3] ..... E06C 1/20

[52] U.S. Cl. ..... 182/170

[58] Field of Search ..... 182/170, 172, 171, 173, 182/177, 176, 175, 174

[56] References Cited

U.S. PATENT DOCUMENTS

| | | | |
|---|---|---|---|
| 42,565 | 5/1864 | Curtiss | 182/170 |
| 848,513 | 3/1907 | Trafton | 182/177 |
| 1,778,898 | 10/1930 | Konisberg | 182/170 |
| 1,783,616 | 12/1930 | Hachmuth | 182/170 |
| 2,184,486 | 12/1939 | Chew | 182/170 |

*Primary Examiner*—Reinaldo P. Machado

*Attorney, Agent, or Firm*—Williamson, Bains, Moore & Hansen

[57] ABSTRACT

A tripod stepladder includes rigid stiles having steps and a platform secured thereto. A hinge plate is pivoted to the platform and to a pair of legs to permit the legs to pivot as a unit towards and away from the stiles. The legs pivot relative to the hinge plate towards and away from each other to an unfolded tripod configuration. An A-shaped linkage limits pivoting movement and stabilizes the legs in the extended position.

5 Claims, 5 Drawing Figures

TRIPOD STEPLADDER

SUMMARY OF THE INVENTION

This invention relates to stepladders, and more particularly to a tripod stepladder.

In the conventional stepladder design, the stepladder includes the steps or ladder portion which is hinged to the leg structure. Conventional stepladders of this type are somewhat stable in a front and rear direction when unfolded but are laterally unstable. If the user leans laterally from the ladder, there is danger of the ladder tipping over. There have been certain prior art attempts to laterally stabilize stepladders with a tripod design, but these efforts were apparently unsuccessful because of the particular design used.

It is therefore an object of this invention to provide a novel tripod stepladder, of simple and inexpensive construction, which, when in the unfolded position, provides an extremely stable structure.

More specifically, it is an object of this invention to provide a novel tripod stepladder having legs which are hinged to the ladder platform to permit lateral swinging as well as fore-and-aft swinging movement thereof, and having a unique linkage which releasably locks the legs of the ladder in the unfolded position.

These and other objects and advantages of this invention will more fully appear from the following description made in connection with the accompanying drawings, wherein like reference characters refer to the same or similar parts throughout the several views.

FIGURES OF THE DRAWINGS

DESCRIPTION OF THE PREFERRED EMBODIMENT OF THE INVENTION

Figure 1:
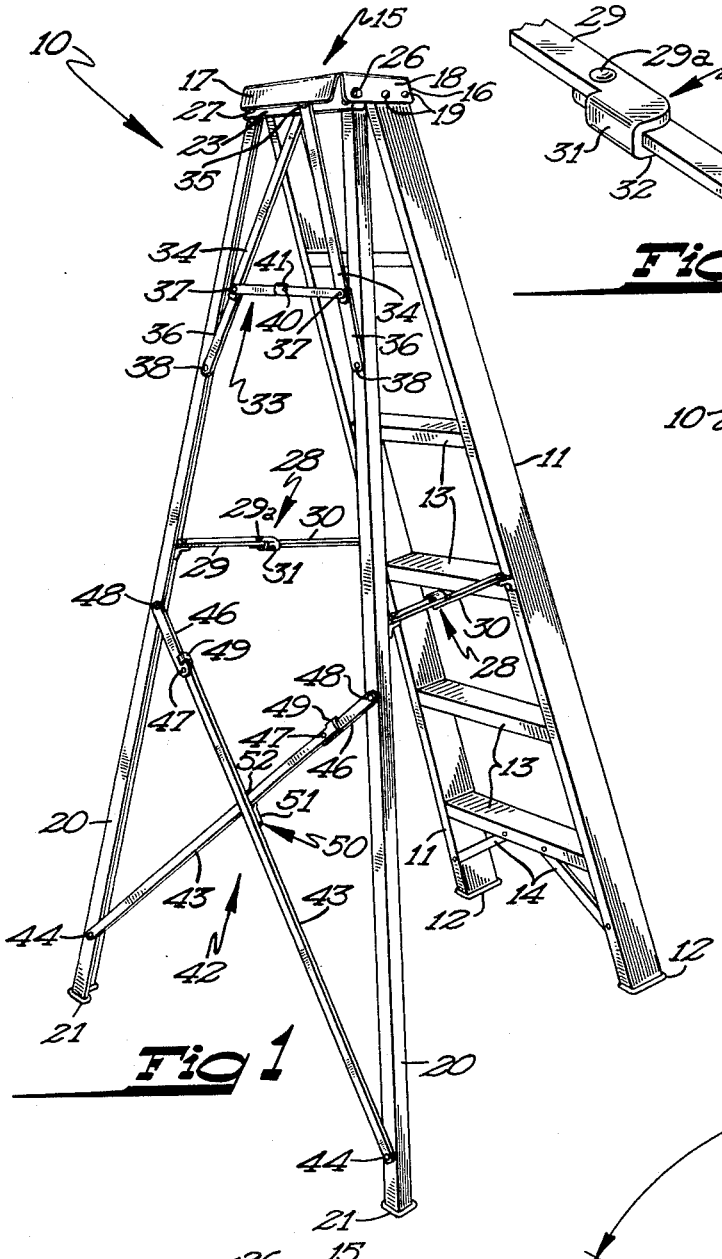
FIG. 1 is a perspective view of the novel ladder in unfolded position.

Referring now to the drawings, and more specifically to FIG. 1, it will be seen that one embodiment of my novel tripod stepladder, designated generally by the reference numeral 10, is thereshown. The stepladder 10 includes a ladder portion comprised of a pair of elongate, substantially straight, generally rectangular shaped stiles or siderails 11, each having a foot element 12 secured to the lower end thereof. Vertically spaced apart, substantially flat rungs or steps 13 extend between and are rigidly connected to the stiles 11. Suitable transverse braces 14 extend between the lower step 13 and the stiles 11, as best seen in FIG. 1.

It is pointed out that the entire stepladder is formed of a suitable rigid material, preferably of lightweight metal such as aluminum, although other rigid materials may be used. The stepladder is provided with a substantially flat, generally rectangular shaped platform at its upper end. The platform 15 is provided with a downturned front flange 16, a downturned rear flange 17, and downturned side flanges 18, the latter being secured by rivets 19 to the upper ends of the stiles 11.

The stepladder 10 also includes a pair of elongate, substantially straight legs 20, each having a foot element 21 secured to the lower end thereof, and each being pivotally connected to the platform 15 by hinge device 22. The hinge device 22 includes a substantially flat, generally rectangular shaped hinge plate 23 having side flanges 24 integral therewith. It will be seen that the side flanges 24 are secured to the side flanges 18 of the platform 15 by pivot bolts 25 provided with suitable nuts 26. The hinge place 23 is pivotal relative to the platform 15 in the fore-and-aft direction about an axis disposed substantially parallel to the steps 13.

The upper ends of the legs 20 are pivoted to the hinge plate 23 by suitable pivot bolt assembly 27 which permit lateral swinging of each leg independently of the other leg about an axis disposed substantially normal to the pivotal axis between the hinge plate and platform 15. With this arrangement, it will be seen that the legs and hinge 23 may swing as a unit in a fore and aft direction, and that the legs may swing independently of each other in a lateral direction about their respective axes.

Figure 3:
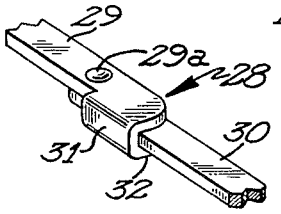
FIG. 3 is an enlarged fragmentary perspective view of certain elements thereof.

Means are provided for limiting swinging movement of the legs and the hinge plate 23 about the pivotal axis between the platform 15 and the hinge plate 23. This means includes a pair of toggle linkages 28 each extending between and interconnecting one of the legs 20 with one of the stiles 11. The toggle linkage 28 includes an elongate link 29 which has one end thereof pivotally connected to one of the legs 20 and is pivotally connected by a pivot *29a* to one end of a second link 30 which has its other end pivotally connected to one of the stiles 11. The link 29 has an offset stop element 31 integral with one end thereof and projecting laterally therefrom. It will be seen that the stop element 31 terminates in a lip 32 as best seen in FIG. 3. This stop element limits pivotal movement of the toggle linkage in a well known manner.

Means are also provided for limiting outward lateral movement of the legs 20 with respect to each other and for stabilizing the legs in their extended position. This means includes a generally A-shaped linkage 33 which pivotally interconnects the legs 20 together and to the central portion of the pivot plate 23. This A-shaped linkage 33 includes a pair of similar elongate, upper diagonal links 34 each having its upper end pivotally connected by a pivot 35 to the central portion of the pivot plate 23. The lower end portion of each upper diagonal link 34 is pivotally connected to the upper end of an elongate lower diagonal link 36 by a pivot 37. The lower end of each lower diagonal link 36 is pivotally connected to one of the legs 20 intermediate the ends thereof by a pivot 38. A pair of elongate, transverse links each have one end thereof pivotally connected to the pivot connection 37 between an upper and lower diagonal link. The transverse links 39 are pivotally connected together by pivot 40. One of the diagonal links 39 is provided with a stop element 41 identical to the stop element illustrated in FIG. 3 for the toggle linkage 28.

Figure 2:
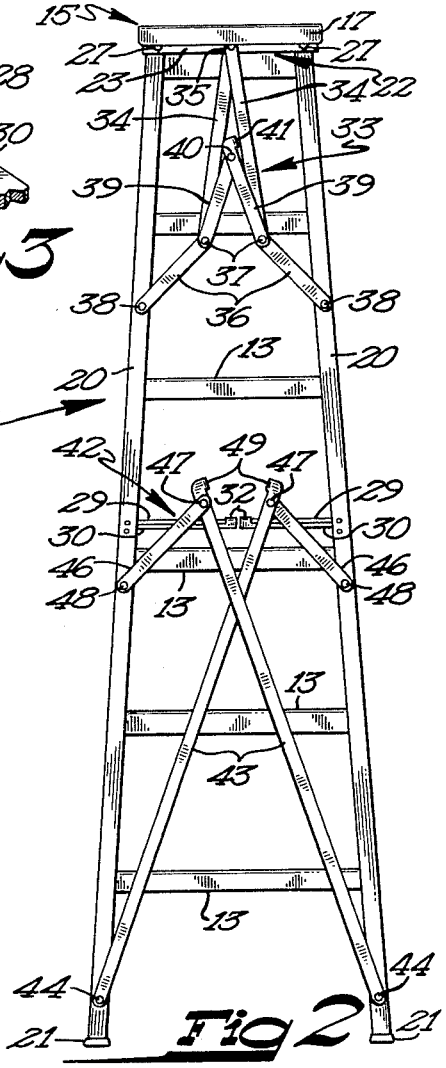
FIG. 2 is a side elevational view of the ladder in folded position.
Figure 4:
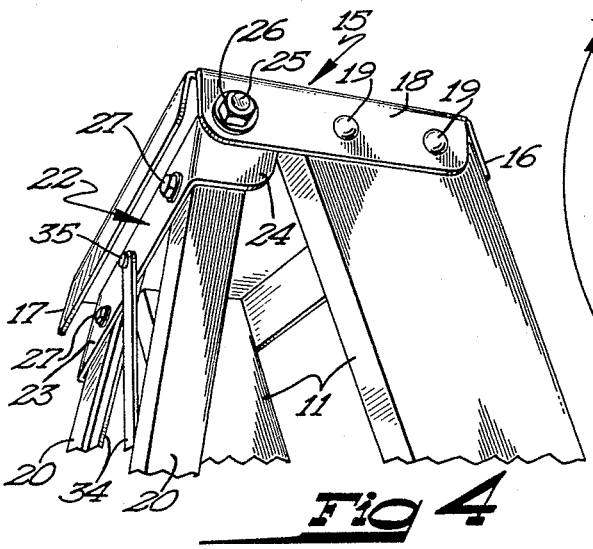
FIG. 4 is a fragmentary perspective view of a portion of the ladder illustrating the details of the construction of the hinge mechanism.

It will be seen that the A-shaped linkage 33 is adapted to be unfolded to an unfolded position, as illustrated in FIG. 1, or it may be folded to a collapsed position as illustrated in FIG. 2. This linkage not only limits lateral movement of the legs 20 away from each other when in the extended or unfolded position, but the linkage also stabilizes the legs 20 in the extended position.

In the embodiment shown, the stepladder 10 is provided with a cross linkage 42 which extends between and interconnects the legs 20 adjacent the lower portion thereof. The cross linkage is intended for use with relatively tall stepladders and may be omitted on conventional smaller (six foot) stepladders. The cross linkage 42 includes a pair of elongate lower cross links 43 each being pivotally connected at its lower end to one of the legs 20 by a pivot 44. The upper end of each lower cross link is pivotally connected to the lower end portion of an elongate upper cross link 46 by pivot 47. The upper end of each upper cross link 46 is pivotally connected by a pivot 48 to one of the legs 20 intermediate the ends of the ladder. Each of the lower cross links 43 has a stop element 49 integral with its upper end which limits pivoting movement when swinging from the folded position, as illustrated in FIG. 2, to the unfolded position as illustrated in FIG. 1. An L-shaped lock member 50 is secured to one of the lower cross links 43 and includes a lower portion 51 having an upper portion 52 integral therewith. The lock member 50 releasably locks the lower cross links together and prevents the links from bowing away from each other.

Figure 5:
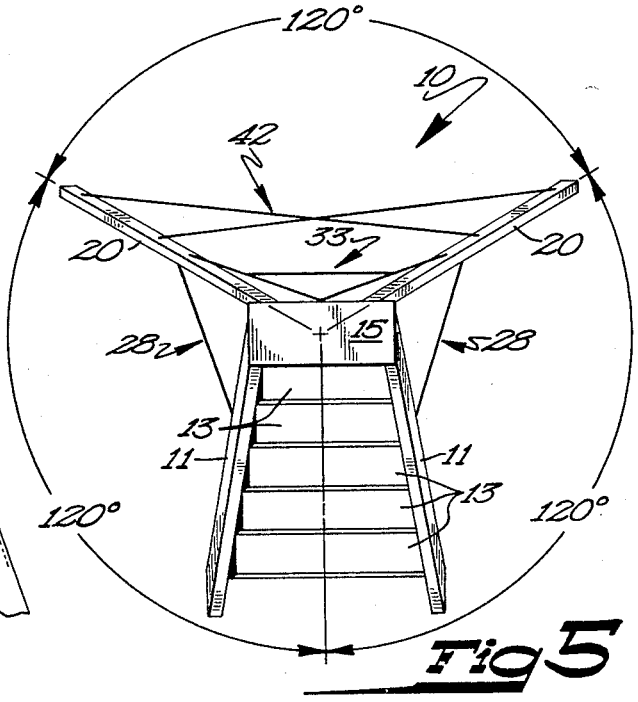
FIG. 5 is a top plan view of the ladder in unfolded position.

In use, the stepladder can be folded to a collapsed position, as illustrated in FIG. 2, for storage in the manner of a conventional stepladder. However, when the ladder is to be used, it may be readily unfolded to its extended position as illustrated in FIGS. 1 and 5. When unfolded, it will be seen that the lower ends of the legs 20 and the latter portion of the stepladder when circumscribed by a circle will define the base of a cone. In this regard, the arc between the lower end of the vertical center line of the ladder portion and the lower end of the longitudinal center line of each leg is 120°. Similarly, the arc defined between the lower end of the center lines of each leg 20 is also 120°. With this arrangement, the ladder is extremely stable against tipping in any direction regardless of where the user stands with respect to the steps 13. Thus, if the user is standing on one side of one of the steps 13, the conical symmetry of the stepladder substantially removes the effect of a tipping moment with respect to the stepladder. The A-shaped linkage stabilizes the legs against movement when the linkage is in its unfolded condition as illustrated in FIG. 1.

When it is desirable to use the stepladder to lean against a vertical surface, the legs 20 may be pivotally laterally even though the hinge plate 23 is in a folded condition. Again, the ladder will be stabilized against lateral tipping when the legs are positioned in this manner.

Thus, it will be seen that I have provided a novel tripod stepladder which is not only of simple and inexpensive construction, but which functions in a more efficient manner than any heretofore known comparable device.

It is anticipated that various changes can be made in the size, shape and construction of the tripod stepladder device disclosed herein without departing from the spirit and scope of my invention as defined by the following claims.

What is claimed is:

1. A tripod stepladder comprising:

a pair of laterally spaced apart, elongate, substantially straight stiles, a plurality of vertically spaced apart, substantially parallel steps extending between and rigidly connected with the stiles, a platform rigidly secured to the top of said stiles, a hinge member hingedly connected to said platform pivoting movement about an axis disposed substantially parallel to the steps, a pair of elongate, substantially straight legs each being pivotally connected to said hinge member for pivotal movement relative thereto about an axis disposed substantially normal to the pivotal axis between the hinge member and said platform to permit swinging movement of said legs as a unit about said first pivotal axis towards and away from said stiles, and permitting swinging movement of said legs about said second axes between extended and non-extended positions, means interconnecting each leg in one of said stiles permitting pivoting movement of said legs away from said stiles about said first pivotal action, a foldable linkage interconnecting said legs and said hinge member including a pair of elongate diagonal links each being connected at one end thereof to the other diagonal link and to said hinge member, and each diagonal link having its other end connected to one of said legs, transverse links interconnecting said diagonal links together intermediate the ends of the latter, said linkage being operable when unfolded to limit movement of said legs and stabilizing the legs in the extended position.

2. The stepladder as defined in claim 1 wherein each of said elongate diagonal links includes an elongate, substantially straight upper diagonal link element being pivotally connected at one end thereof to one end of a lower diagonal link element.

3. The stepladder as defined in claim 2 wherein said linkage when in the unfolded position is of generally A-shaped configuration.

4. The stepladder as defined in claim 2 wherein said transverse links are interconnected to the pivot connection between each upper and lower diagonal link elements.

5. The stepladder as defined in claim 1 wherein said hinge member comprises a substantially flat plate.

* * * * *